US005626926A

United States Patent [19]

Roberts

[11] Patent Number: 5,626,926

[45] Date of Patent: May 6, 1997

[54] STAND-ALONE DECORATIVE ASSEMBLY

[75] Inventor: Gilchrist P. Roberts, Snellville, Ga.

[73] Assignee: Lin Pac, Inc., Atlanta, Ga.

[21] Appl. No.: 321,913

[22] Filed: Oct. 12, 1994

[51] Int. Cl.[6] ..... G09F 7/18

[52] U.S. Cl. ..... 428/14; 40/611; 40/733; 428/904.4

[58] Field of Search ..... 428/14, 904.4; 40/605, 611, 733, 765; 52/475.1

[56] References Cited

U.S. PATENT DOCUMENTS

| | | | |
|---|---|---|---|
| 1,463,722 | 7/1923 | O'Boyle | 428/14 |
| 2,373,778 | 4/1945 | Quinby | 40/605 |
| 2,467,581 | 4/1949 | Connell | 52/475.1 |
| 2,616,197 | 11/1952 | Osburn | 40/733 |
| 3,817,396 | 6/1974 | Markson | 40/605 X |
| 4,100,709 | 7/1978 | Good | 52/475.1 X |
| 4,679,341 | 7/1987 | Goldman | 40/152 X |
| 5,138,780 | 8/1992 | Kunkel | 40/152 |

*Primary Examiner*—Henry F. Epstein
*Attorney, Agent, or Firm*—Finnegan, Henderson, Farabow, Garrett & Dunner

[57] ABSTRACT

A stand-alone decorative assembly comprising at least two hingedly connected frames. Each of the frames includes a frame member, which define an open display area. The assembly also includes a substantially rigid, decorative panel for each of the frames. The panels are removably supported by the frames, so that front and back surfaces of each panel are exposed along the open display area.

7 Claims, 2 Drawing Sheets

STAND-ALONE DECORATIVE ASSEMBLY

BACKGROUND OF THE INVENTION

The present invention relates to a stand-alone decorative assembly for use as a furniture screen or the like. More particularly, the present invention pertains to a decorative assembly including a frame and a removable decorative panel.

The use of a decorative furniture screen to accent a room or to serve as a partition is well-known. Conventional screens include two or more hinged panels, which stand upright when the panels are aligned at an angle relative to one another. The panels typically include designs formed on wood, brass, or glass. Alternatively, the panels may be covered with an attractive fabric.

Conventional screens typically are designed to accommodate a specific decor. Modifying the screen for use with another decor oftentimes is not possible. Even when the screen may be modified, it usually is both expensive and time-consuming.

SUMMARY OF THE INVENTION

Accordingly, the present invention is directed to a stand-alone decorative assembly that substantially obviates one or more of the limitations of the related art.

To achieve these and other advantages and in accordance with the purpose of the invention, as embodied and broadly described herein, the stand-alone decorative assembly comprises at least two hingedly connected frames. Each of the frames includes frame members, which define an open display area. The assembly also includes a substantially rigid, decorative panel for each of the frames. The decorative panels are removably supported by the frames, so that front and back surfaces of each panel are exposed along the open display area.

Preferably, the panel is formed of corrugated paper-board or solid foam insulation. The panel also may be wood, metal or glass. In accordance with the present invention, a decorative sheet is attached to at least one of the front and back surfaces of the panel. The decorative sheet may be paper, plastic, fabric, metal foil, or the like.

An alternate embodiment of the stand-alone decorative assembly of the present invention comprises at least two hingedly connected support members having a longitudinal groove and aligned ends. This embodiment also includes a pair of substantially rigid, decorative panels, each having an edge adapted to be inserted in a respective groove along each support member. Accordingly, the panel stands upright, thereby providing a display surface along the front and back of the panel.

Another preferred embodiment of the present invention pertains to a floor-mounted furniture screen frame having a transverse groove extending along an upper surface of the frame. The assembly also includes a substantially rigid, decorative panel removably supported along the frame. An edge of the panel is adapted to be inserted within the groove, thereby enabling the panel to stand upright, and also providing a display surface on the front and back surfaces of the panel. It is to be understood that both the foregoing general description and the following detailed description are exemplary, and are intended to provide further explanation of the invention as claimed. The accompanying drawings are included to provide a further understanding of the invention and are incorporated in and constitute part of this specification. The drawings illustrate embodiments of the invention and, together with their description, serve to explain the principles of the invention.

DETAILED DESCRIPTION

Figure 1:
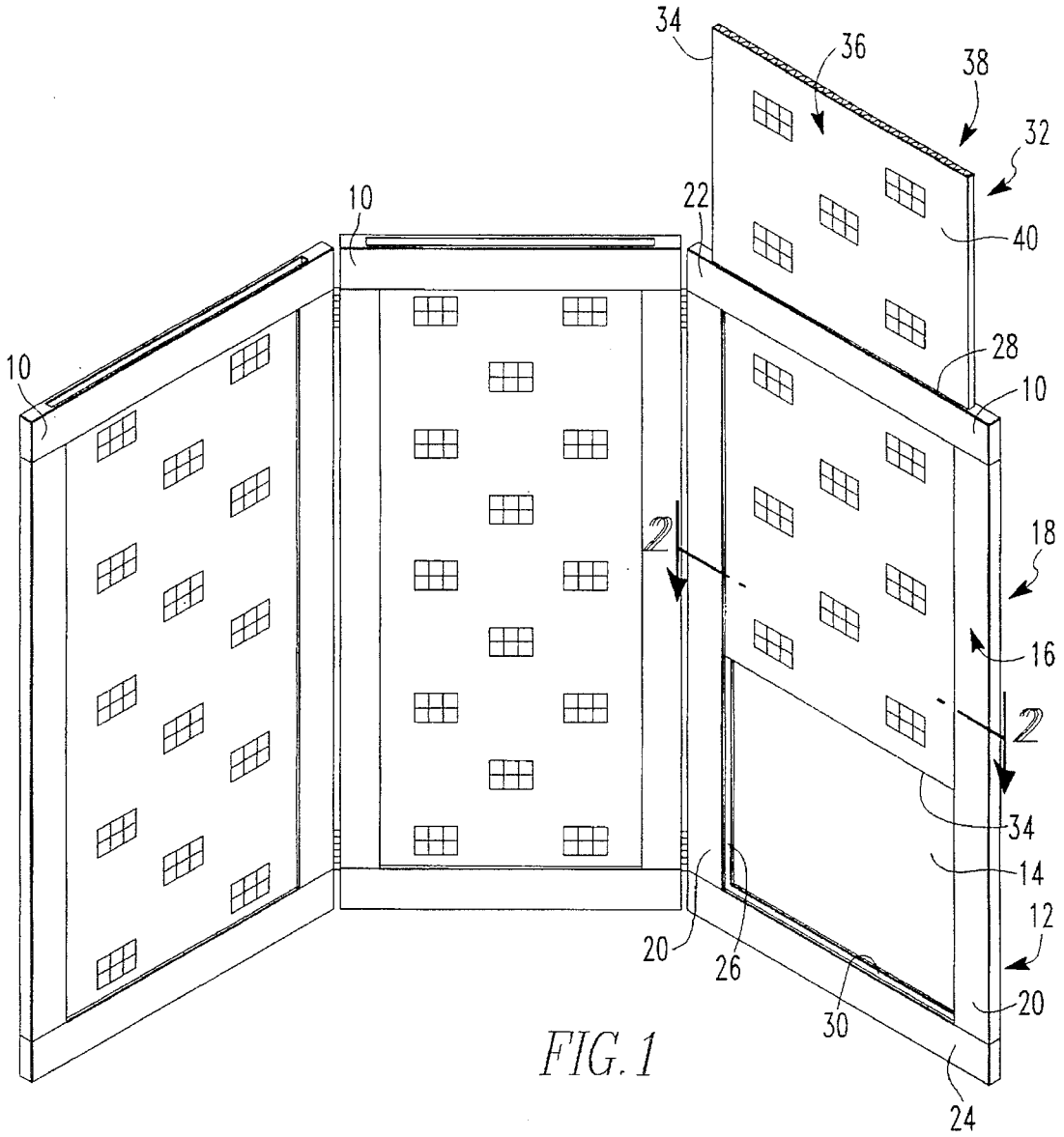
FIG. 1 is a perspective view of the decorative assembly of the present invention with a decorative panel partially removed from the assembly.

Reference will now be made to the present preferred embodiments of the invention, examples of which are illustrated in the accompanying drawings.

In accordance with the present invention, a stand-alone decorative assembly includes a frame and a decorative panel adapted to be removably mounted on the frame. As embodied herein and shown principally in FIGS. 1 and 2, the decorative assembly preferably includes at least two hingedly connected frames 10 made of wood, metal, plastic, or a combination thereof. Such frames 10 have various uses and may stand 2–6' or more in height. Typically, the decorative assembly stands alone by bending one frame 10 relative to another. The frame 10, however, also may be stabilized by legs or a widened planar bottom surface.

As embodied herein, each of the frames 10 includes frame members 12 defining a display area 14. The display area 14 preferably is open along front and back surfaces 16, 18 of each frame 10.

As shown in FIG. 1, the frame members 12 include opposite side members 20 connected together at opposite ends by top and bottom frame members 22, 24. The opposite side members 20 include a substantially continuous groove 26. Preferably, the top frame member 22 has a slot 28 that is aligned with the grooves 26 on the opposite side members 20. The slot 28 provides an entrance leading exteriorly of the frame 10 and communicating with the display area 14. Also, the bottom frame member 24 may include a bottom groove 30 aligned with the grooves 26 extending along the opposite side members 18.

Figure 2:
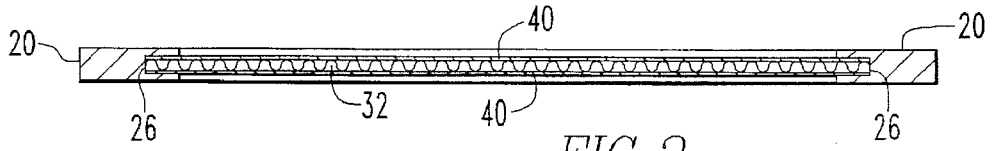
FIG. 2 s a cross-section of the assembly taken along lines 2—2 in FIG. 1.

As embodied herein and shown principally in FIGS. 1 and 2, the decorative assembly preferably includes a substantially rigid, decorative panel 32 removably supported within the grooves 26, 30 along the frame 10. As shown in FIG. 1, the decorative panel 32 is adapted to be inserted within the slot 28, so that edges 34 of the panel 32 are aligned with the grooves 26, enabling the panel 32 to be slid into the display area 14. Accordingly, front and back surfaces 36, 38 of the panel 32 are exposed along the central display area 14. Preferably, the edges 34 of the panel are substantially concealed within the grooves 26, 30 along the side and bottom frame members 20, 24, and at least to some extent by the top frame member 24.

As embodied herein, the decorative panel 32 may be corrugated paperboard having a laminated sheet 40 attached to at least one of the front and back surfaces 36, 38. The panel 32 also may be formed of foam, wood, metal or glass. Likewise, the decorative sheet 40 may be paper, plastic, fabric, metal foil, or the like. As such, the panels 32 may be designed with wallpaper corresponding to the wallpaper in a room. Further, inasmuch as the panel 32 is removable, multiple panels may be inserted on a routine basis. Indeed, the slot 28 may be sized to accommodate more than one panel 32, thereby allowing the user to store alternate designs.

Figure 3:
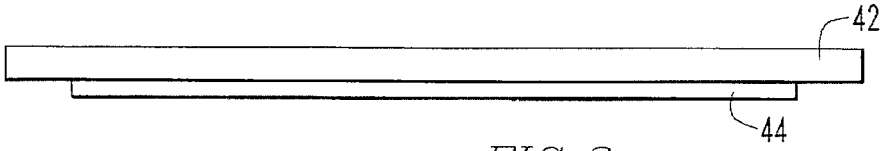
FIG. 3 is a side elevation view of a cap member for use with the assembly illustrated in FIG. 1.

As embodied herein and shown in FIG. 3, the decorative assembly preferably includes a cap member 42 having a base 44 seated within the slot 28. The cap member 42 prevents the upper edge 34 of the panel 32 from being viewed through the slot 28. The cap member 42 may have various shapes and dimensions sufficient to conceal the upper edge 34 of the panel 32.

In accordance with the present invention, the slot 28 may be formed on one of the side members 20 enabling the panel 32 to be inserted lengthwise into the frame. The slot 28 also may be formed on the bottom frame member 24. The cap member 42 may be used regardless of the location of the slot 28. Thus, if the slot 28 is formed along the bottom frame member 24, the cap member 42 will support the panel 32 along its bottom surface.

Figure 4:
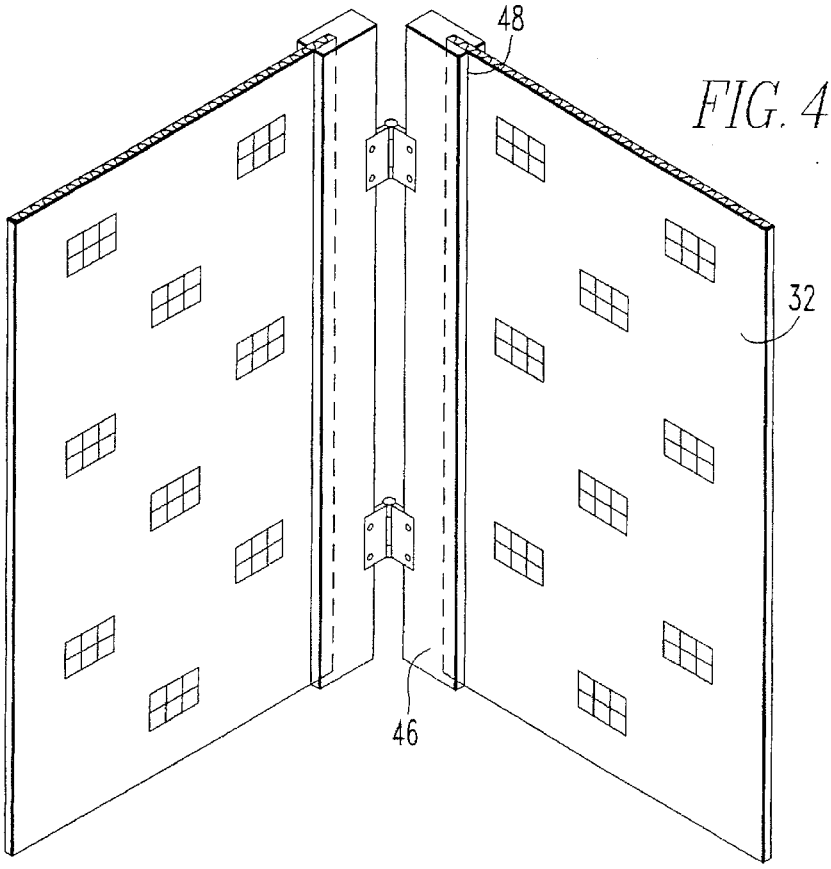
FIG. 4 is a perspective view of another embodiment of the assembly of the present invention.
Figure 5:
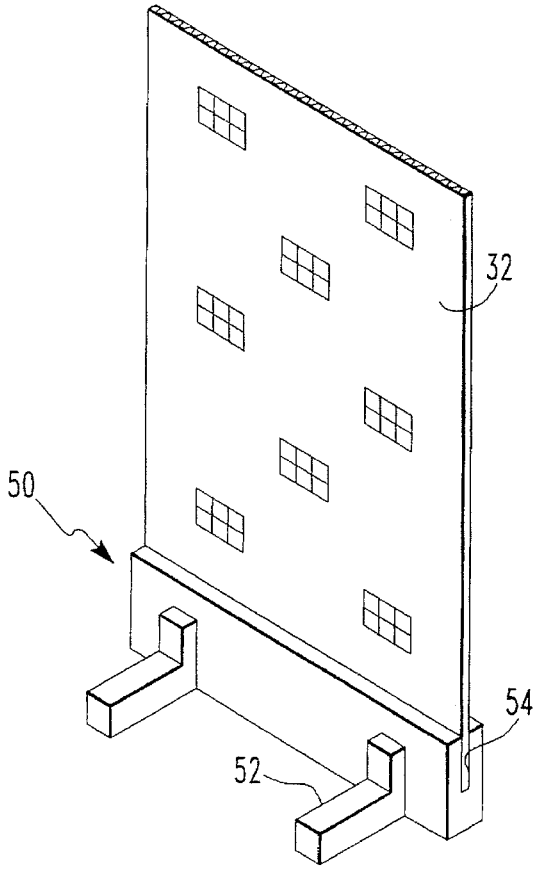
FIG. 5 is a perspective view of still another embodiment of the assembly of the present invention.

An alternative embodiment of the decorative assembly of the present invention is shown in FIG. 4. In this embodiment, a pair of hingedly connected support members 46 are adapted to hold the adjoining panels 32 upright along a longitudinal groove 48. In another embodiment, which is shown in FIG. 5, the furniture screen includes a support base 50 having legs 52 for stabilizing the support base 50, as well as a transverse groove 54 extending along an upper surface of the support base 50 for holding the panel 32 upright.

In each of the embodiments of the present invention, reinforcement may be provided along the grooves 48,54 to ensure the panel 32 is securely mounted. Further, in the embodiments shown in FIGS. 4 and 5, U-shaped metal or plastic frames may be attached along exposed edges 34 of the panel 32, thereby concealing fluting, for example, if the panel is corrugated paperboard.

The present invention provides a decorator with versatility in designing a partition or furniture screen for enhancing the appearance of a room. The panels 32, which are removable and reversible, may be laminated with wallpaper or posters, and eventually replaced at a fraction of the cost of conventional furniture screens. A particularly desirable embodiment involves the use of pressure sensitive paper, which has a backing that must be peeled off before the paper is applied to the panel 32. In this situation, an end user has the opportunity to select the desired decorative paper to be used on the blank panel 32.

It will be apparent to those skilled in the art that various modifications and variations can be made to the structure and methodology of the present invention without departing from the scope or spirit of the invention. For example, it may be desirable to use a different decorative surface on one side of the panel 32 than on the other. It also may be desirable for the cap member 42 to be ornate in design, yet capable of functioning as described herein. In view of the foregoing, it is intended that the present invention cover modifications and variations of the invention, provided they come within the scope of the appended claims and their equivalence.

What is claimed is:

1. A stand-alone decorative assembly comprising:

a frame having opposite side members connected together at opposite ends by top and bottom frame members respectively, said bottom frame member being shaped to provide stand-alone stability to said frame;

said frame members defining a central display area therebetween, said display area being open along front and back surfaces of said frame;

grooves extending along opposite frame members separated by said display area;

a slot formed in one of said frame members, said slot being aligned with said grooves, said slot having an entrance leading exteriorly of said frame and communicating with said display area; and a substantially rigid corrugated paperboard, decorative panel removably supported along said frame and adapted to be inserted within said slot, said panel having a bottom edge supported by said bottom frame member, said panel having ends adapted to be aligned within said grooves for sliding said panel into said display area, whereby front and back surfaces of said panel are exposed along said central display area.

2. The decorative assembly as defined in claim 1, wherein said panel includes a decorative sheet attached to at least one of said front and back surfaces.

3. The decorative assembly as defined in claim 2, wherein said decorative sheet is selected from a group consisting of paper, plastic, fabric, and metal foil.

4. The decorative assembly as defined in claim 1, further including a cap member adapted to be seated within said slot.

5. The decorative assembly as defined in claim 1, wherein said slot is formed along a top portion of said frame member.

6. The decorative assembly as defined in claim 1, wherein said slot is formed along a side portion of said frame member.

7. The decorative assembly as defined in claim 1, wherein said slot is formed along a bottom portion of said frame member.

* * * * *